US008089018B2

(12) United States Patent
Mitsuoka

(10) Patent No.: US 8,089,018 B2
(45) Date of Patent: Jan. 3, 2012

(54) MOVABLE CONTACT UNIT AND METHOD OF MANUFACTURING THE SAME

(75) Inventor: Hideki Mitsuoka, Okayama (JP)

(73) Assignee: Panasonic Corporation, Osaka (JP)

( * ) Notice: Subject to any disclaimer, the term of this patent is extended or adjusted under 35 U.S.C. 154(b) by 183 days.

(21) Appl. No.: 12/270,241

(22) Filed: Nov. 13, 2008

(65) Prior Publication Data

US 2009/0152090 A1 Jun. 18, 2009

(30) Foreign Application Priority Data

Dec. 18, 2007 (JP) ..... 2007-325566

(51) Int. Cl.
*H01H 1/10* (2006.01)

(52) U.S. Cl. ..... 200/516; 200/406

(58) Field of Classification Search ..... 200/516, 200/515

See application file for complete search history.

(56) References Cited

U.S. PATENT DOCUMENTS 6,593,537 B2 * 7/2003 Teruyama et al. ..... 200/515
6,604,278 B2 * 8/2003 Sera et al. ..... 29/622

FOREIGN PATENT DOCUMENTS

CN 1371110 A 9/2002
JP 8-306261 A 11/1996
JP 2002-245898 8/2002

OTHER PUBLICATIONS

Chinese Office Action dated Dec. 21, 2010.

* cited by examiner

*Primary Examiner* — Elvin G Enad
*Assistant Examiner* — Lisa Klaus
(74) *Attorney, Agent, or Firm* — Pearne & Gordon LLP

(57) ABSTRACT

A movable contact unit, of which an upper surface of a movable contact made of a conductive metal plate is adhesively fixed to an adhesive layer formed on the underside of a base film, an upper surface of a separator is affixed to the adhesive layer in a manner to sandwich the movable contact between them, and the periphery of the movable contact is heated and pressed in a circular shape from above of the base film to form a convex-shaped portion in an area of base film corresponding to the movable contact in a manner to fit along a dome-like shape of the movable contact and to make a peripheral area or a base of the convex-shaped portion pressed circularly to close adhesion to the separator with the adhesive layer. By virtue of this structure, there can be an improvement of manufacturing efficiency of the movable contact unit.

7 Claims, 6 Drawing Sheets

MOVABLE CONTACT UNIT AND METHOD OF MANUFACTURING THE SAME

BACKGROUND OF THE INVENTION

1. Field of the Invention

The present invention relates to a movable contact unit used for a control panel and the like of various electronic apparatuses, and the invention also relates to a method of manufacturing the same.

2. Background Art

With the recent trend of reduction in sizes and thickness of various electronic apparatuses, there is a continuous increase in number of portable and easy-to-carry apparatuses such as mobile phones, and this trend has been pushing ahead with development of such panel switches as featuring low profile with capability of yielding good tactile responses to actuations for use as control panels and the like of these apparatuses. A large number of the movable contact units now being employed are the type that uses movable contacts of dome-like shape formed of conductive metal plates having elasticity since they can provide reliable electrical contacts.

Referring now to FIG. 6 to FIG. 10, description is provided of a conventional movable contact unit of such type and a manufacturing method thereof as disclosed in Japanese Patent Unexamined Publication, No. 2002-245898.

Sectioned views among these drawings are enlarged dimensionally only in one direction along their thickness for the purpose of making the structures easily comprehensible.

FIG. 6 is a sectioned view of the conventional movable contact unit, and FIG. 7 is an exploded perspective view of the same. In these drawings, movable contact unit 4 comprises base film 1 having an insulating property and flexibility formed into a predetermined outer shape, and a plurality of downwardly opened dome-like movable contacts 3, of which upper surfaces are fixed to the underside of base film 1 with adhesive layer 2. Polyethylene terephthalate (hereinafter referred to as "PET") is one example of materials used for base film 1, and a thin sheet of electrically conductive metal is used for movable contacts 3.

Movable contact unit 4 is pasted with adhesive layer 2 in a removable manner onto a surface of a release layer formed on an upper surface of insulative separator 5 made of PET or the like material. This prevents corrosion of movable contacts 3, and keeps adhesive layer 2 on the underside of base film 1 from accidentally adhering to other parts and collecting undesirable objects during transportation and storage.

In FIG. 6 and FIG. 7 here, separator 5 is illustrated as being rectangular in shape corresponding to the size of movable contact unit 4. It is the general practice, however, that separator 5 is formed into a belt-like strip to allow placement of a plurality of movable contact units 4, as shown in the perspective view of conventional movable contact units in FIG. 8, in the light of convenience for transportation and storage.

Movable contact units 4 of the above structure placed on the upper surface of separator 5 are manufactured in the following manner.

First, a required number of downwardly opened dome-like movable contacts 3 are fixed in their respective positions by adhering upper center surfaces thereof to adhesive layer 2 formed on the underside of base film 1.

Next, the entire surface of movable contact unit 4 is adhered to belt-like separator 5 made of an insulation film by using adhesive layer 2 on the underside of base film 1 in a manner to sandwich movable contacts 3, as shown in a sectioned view of FIG. 9 depicting a method of manufacturing the conventional movable contact unit, and this product is designated as work-in-process item 6.

Work-in-process item 6 is then placed with base film 1 side up and separator 5 side down on top of rubber sheet 8 of about 1 mm thickness laid on press table 7 made of a metallic material such as iron.

Press die 9 heated by a heater (not shown) and positioned above base film 1 is then moved down to heat and press (hereinafter described as "hot press") work-in-process item 6 from the upper side of base film 1.

Press die 9 used here is so formed that a number of portions 9A corresponding to movable contacts 3 are hollowed to avert hot pressing upon areas occupied by movable contacts 3. Flat face 9B thus shaped is capable of pressing the entire surface of work-in-process item 6 except where movable contacts 3 are disposed.

The hot press is carried out under the conditions of 80 to 130° C. in temperature and 0.1 to 0.3 MPa in pressure for 1 to 3 seconds, to complete the manufacturing process of movable contact unit 4 affixed to separator 5.

The hot press carried out in the above manner can bring base film 1 into close adhesion to movable contacts 3 along the dome-like shape, while also preventing base film 1 from coming off separator 5 in areas around the outer rims of movable contacts 3. This method ensures flat surface portions of a sufficient area between adjoining movable contacts 3 for adhesion with separator 5 even when movable contacts 3 are arranged closely with respect to one another. Accordingly, this method achieves consistency of the fixing positions of movable contacts 3 as well as steadiness of adhesion by way of increasing an overall area of adhering surface when movable contact unit 4 is bonded to a wiring board.

A plurality of movable contact units 4 adhered in this manner are arranged at regular intervals on belt-like separator 5, as shown in the perspective view of conventional movable contact units 4 in FIG. 8, and they are transferred by means of pilot holes 5A provided at regular intervals along separator 5. As movable contact units 4 are transferred, the process of hot press is carried out on the entire surface of press-on portion 10 of base film 1 except for the areas where movable contacts 3 are disposed FIG. 10 is a sectioned view of a conventional switch that uses movable contact unit 4. Switch 15 comprises movable contact unit 4, which is removed from separator 5 and bonded to an upper surface of wiring board 11. Movable contact unit 4 is bonded to wiring board 11 in a position that outer rims of constituent movable contacts 3 lie on outer stationary contacts 12B, and lower center surfaces of movable contacts 3 confront respective center stationary contacts 12A with a predetermined space between them.

Switch 15 constructed as above is used for a portable information-handling device requiring a low-profile structure such as a mobile phone, for example. When this is the case, the switch is placed inside an enclosure case in a manner that the movable contacts are located behind dial buttons and the like, and connected to a control circuit so that the control circuit detects and executes communication control and the like tasks when the dial buttons are pushed.

In the structure discussed above, when a certain amount of pressing force is applied to movable contact 3 from the upper surface of base film 1, movable contact 3 elastically deforms downward into an inverse shape with a tactile click, and the lower center portion of movable contact 3 comes in contact with center stationary contact 12A. This establishes an electrical continuity between center stationary contact 12A and outer stationary contact 12B via movable contact 3.

When the pressing force is removed thereafter from the upper surface of base film 1, movable contact 3 elastically deforms upward into the original shape by its own elastic restoring force. This results in separation of the lower center portion of movable contact 3 from center stationary contact 12A to resume the electrically open state between center stationary contact 12A and outer stationary contact 12B.

In this conventional movable contact unit and the manufacturing method, base film 1 can be processed by the hot press to deform it along the dome-like shape down to the rims of movable contacts 3 since both base film 1 and separator 5 are formed of film materials such as PET. On the other hand, however, there occurs a small extent of deformation in any of base film 1 and separator 5.

An extent of the deformation is not so significant for each set of movable contact unit 4 that it hardly causes any problems in the process of manufacturing when only one set of movable contact unit 4 is adhered onto separator 5. When a plurality of movable contact units 4 are adhered onto separator 5, however, even a small deformation developed in separator 5 can accumulate. As a result, there emerges a substantial deviation in positions of pilot holes 5A used as the reference in a process of forwarding separator 5 from the press table after the hot press, thereby giving rise to a problem of decreasing productivity of movable contact units 4.

There is also a drawback with the above configuration wherein the plurality of movable contact units 4 are disposed at regular intervals on the belt-like separator 5, that a positional correction needs to be repeated frequently due to a cumulative increase in the positional deviation of pilot holes 5A when movable contact units 4 are mounted continuously onto wiring boards 11. This poses another problem of decreasing the efficiency of producing electronic apparatuses.

SUMMARY OF THE INVENTION

The present invention addresses the above problems of the conventional art, and provides a movable contact unit and a manufacturing method thereof, which is contrived to reduce deformation attributed to hot press, as compared to the ordinary movable contact unit manufactured by the conventional method, so as to improve an efficiency of manufacturing an electronic apparatus.

The movable contact unit of the present invention comprises a base film, an adhesive layer formed on the underside of the base film, and a downwardly opened dome-like movable contact adhesively fixed to the adhesive layer, wherein the base film has a press-on portion of a circular shape formed by hot press around a peripheral part, or a base of a convex-shaped portion retaining the movable contact, and the base film is in close adhesion with the movable contact from a dome-like top portion down to an outer rim thereof.

By virtue of this structure, the deformation attributed to the hot press becomes smaller as compared to the movable contact unit manufactured by the conventional method. It can thus improve an efficiency of manufacturing the movable contact unit as well as an efficiency of manufacturing an electronic apparatus equipped with a switch comprised of the movable contact unit bonded to a wiring board.

A method of manufacturing a movable contact unit of the present invention comprises a first step of fixing a movable contact of a downwardly opened dome-like shape made of a conductive metal plate having elasticity by adhering an upper center surface thereof to an adhesive layer formed on the underside of a base film, a second step of adhering an upper surface of a separator onto the adhesive layer in a manner to sandwich the movable contact between them, and a third step of hot-pressing in a circular shape the periphery of the movable contact from above the base film to form a convex-shaped portion in an area of the base film corresponding to the movable contact in a manner to fit along the dome-like shape of the movable contact, and to make a peripheral area, or a base of the convex-shaped portion pressed circularly into close adhesion to the separator with the adhesive layer.

Accordingly, the structure can improve the efficiency of manufacturing the movable contact unit as well as the efficiency of manufacturing the electronic apparatus equipped with a switch comprised of the movable contact unit bonded to a wiring board.

DETAILED DESCRIPTION OF THE INVENTION

Figure 1:
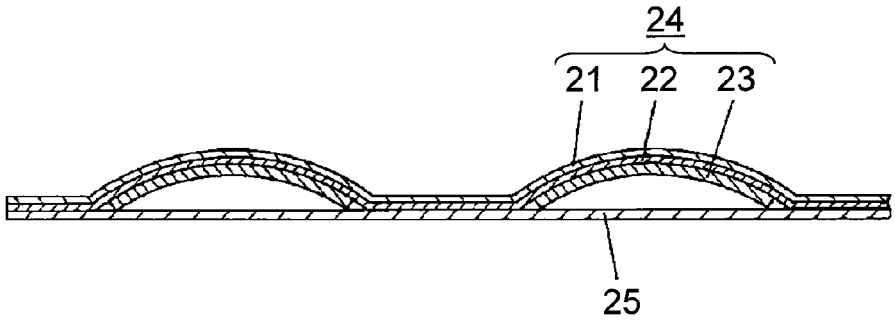
FIG. 1 is a sectioned view of a movable contact unit according to an exemplary embodiment of the present invention.

Description is provided hereinafter of an exemplary embodiment of the present invention with reference to FIG. 1 to FIG. 5. Like reference numerals are used to designate like structural components as those described in the background art, and their details will be repeated only briefly.

Figure 2:
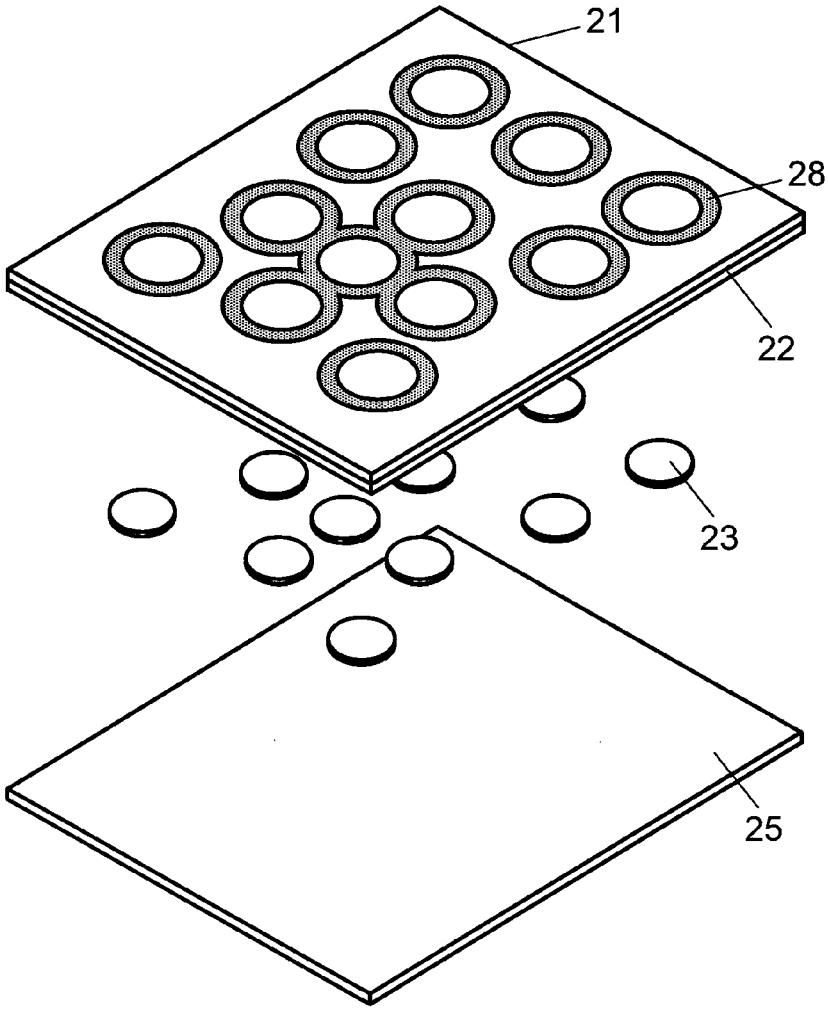
FIG. 2 is an exploded perspective view of the movable contact unit.

FIG. 1 is a sectioned view of a movable contact unit according to an exemplary embodiment of the present invention, and FIG. 2 is an exploded perspective view of the same. In these drawings, each movable contact unit 24 comprises base film 21 of an insulation material having flexibility formed into a predetermined outer shape, and a plurality of downwardly opened dome-like movable contacts 23 made of thin sheets of electrically conductive metal, which are fixed to adhesive layer 22 formed on the underside of base film 21. Movable contact unit 24 is pasted with adhesive layer 22 in a removable manner onto an upper surface of separator 5 having a release layer formed thereon. Insulation materials such as PET are used for base film 21 and separator 25, and a thin sheet of electrically conductive metal is used for movable contacts 23.

Base film 21 is hot-pressed at areas around peripheral parts, or bases of convex-shaped portions retaining movable contacts 23 individually. Base film 21 is in close adhesion with movable contacts 23 from dome-like top portions down to outer rims thereof, and press-on portions 28 are thus formed by being hot-pressed in generally a circular shape around the peripheral parts, or the bases of the convex-shaped portions retaining movable contacts 23.

In FIG. 1 and FIG. 2, separator 25 is illustrated here as being rectangular in shape corresponding to the size of movable contact unit 24. It is the general practice, however, that separator 25 is formed into a belt-like strip to allow placement of a plurality of movable contact units 24, as shown in a perspective view of movable contact units in FIG. 3, in the light of convenience in the manufacturing, transportation and storage.

Movable contact units 24 of this structure placed on separator 25 are manufactured in the following manner.

Figure 4:
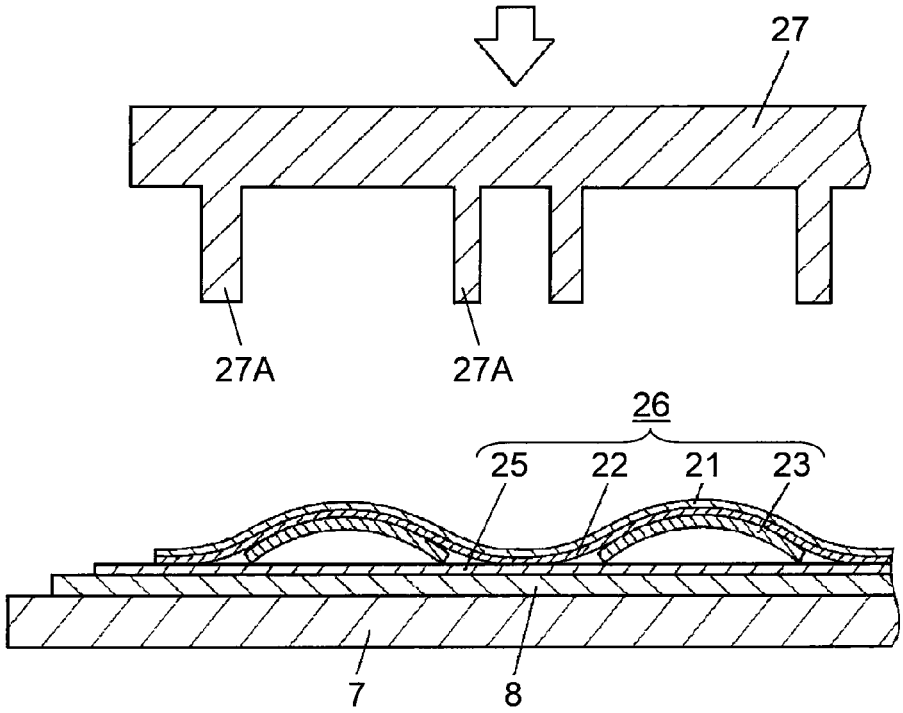
FIG. 4 is a sectioned view illustrating a method of manufacturing the movable contact unit according to one exemplary embodiment of the present invention.

First, a required number of downwardly opened dome-like movable contacts 23 are fixed in their respective positions by adhering upper center surfaces thereof to adhesive layer 22 formed on the underside of base film 21. Next, an entire surface of movable contact unit 24 is adhered to belt-like separator 25 made of an insulation film by using adhesive layer 22 on the underside of base film 21 in a manner to sandwich movable contacts 23, as shown in a sectioned view of FIG. 4 depicting a method of manufacturing the movable contact unit of the present invention, and this product is designated as work-in-process item 26.

Work-in-process item 26 is then placed with base film 21 side up and separator 25 side down on top of rubber sheet 8 of about 1 mm thickness laid over press table 7 made of a metal material such as iron.

Press die 27 heated by a heater (not shown) and positioned above base film 21 is then moved down to hot press work-in-process item 26 from the upper side of base film 21.

Press die 27 used here has a number of flat faces 27A for pressing in generally a circular shape around the peripheral parts of movable contacts 23, and this hot press is carried out under the conditions of 80 to 130° C. in temperature and 0.1 to 0.3 MPa in pressure for 1 to 3 seconds.

The hot press carried out in this manner can bring base film 21 into close adhesion to movable contacts 23 along their dome-like shape. At the same time, the hot press also produces press-on portions 28 of generally the circular shape (refer to FIG. 3) around the peripheries of movable contacts 23, or the bases of the convex-shaped portions formed in base film 21 by movable contacts 23. This process can hence prevent base film 21 from coming off separator 25. The process can also ensure flat surface portions of a sufficient area between adjoining movable contacts 23 for adhesion with separator 25 even when movable contacts 23 are arranged closely with respect to one another.

In addition, the present invention reduces an overall area of surfaces where the hot press is applied on base film 21 since base film 21 is pressed and affixed closely to separator 25 only around the bases of the convex-shaped portions covering the peripheries of movable contacts 23 in a manner to form press-on portions 28 of generally the circular shape. The invention can thus alleviate to a satisfiable degree the deformation of base film 21 and separator 25 attributed to the hot press as compared to the conventional method since there is hardly any deformation to develop in other areas that are not hot-pressed.

Figure 3:
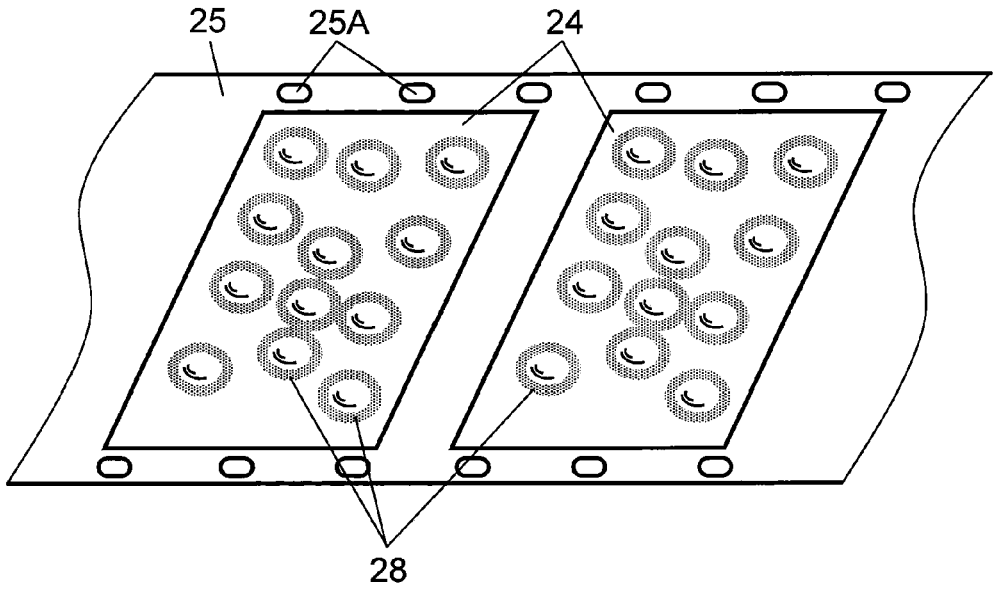
FIG. 3 is a perspective view of the same movable contact unit.

A plurality of movable contact unit 24 adhered in this manner are arranged at regular intervals on belt-like separator 25, as shown in the perspective view of movable contact units 24 in FIG. 3, and they are transferred by means of pilot holes 25A provided at regular intervals along separator 25. As movable contact units 24 are transferred, the hot press is carried out in generally the circular shape around the peripheries of movable contacts 23 on base film 1, except where movable contacts 23 are disposed.

When the plurality of movable contact units 24 are bonded one after another onto wiring boards 11, there are not any deformations developed by the hot press in separator 25 except in the areas corresponding to press-on portions 28 of base films 21. It thus becomes possible to continuously bond movable contact units 24 to wiring boards 11 without making correction of their positions since there is no positional deviation between them even when pilot holes 25A are used as the reference for setting the bonding positions.

Figure 5:
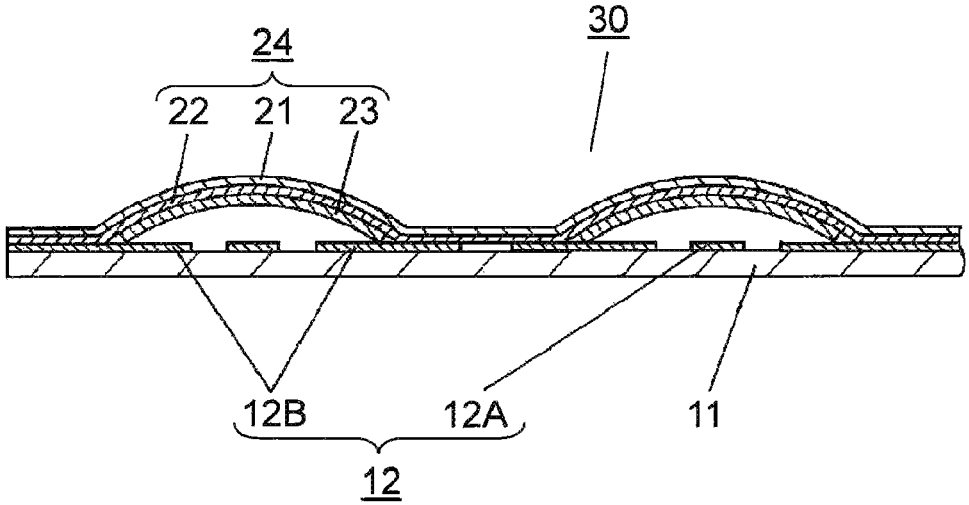
FIG. 5 is a sectioned view of a switch provided with the movable contact unit.
Figure 6:
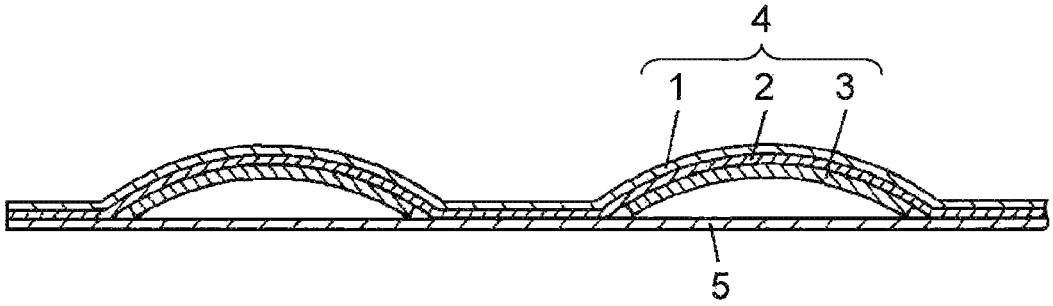
FIG. 6 Prior Art
FIG. 6 is a sectioned view of a conventional movable contact unit.
Figure 7:
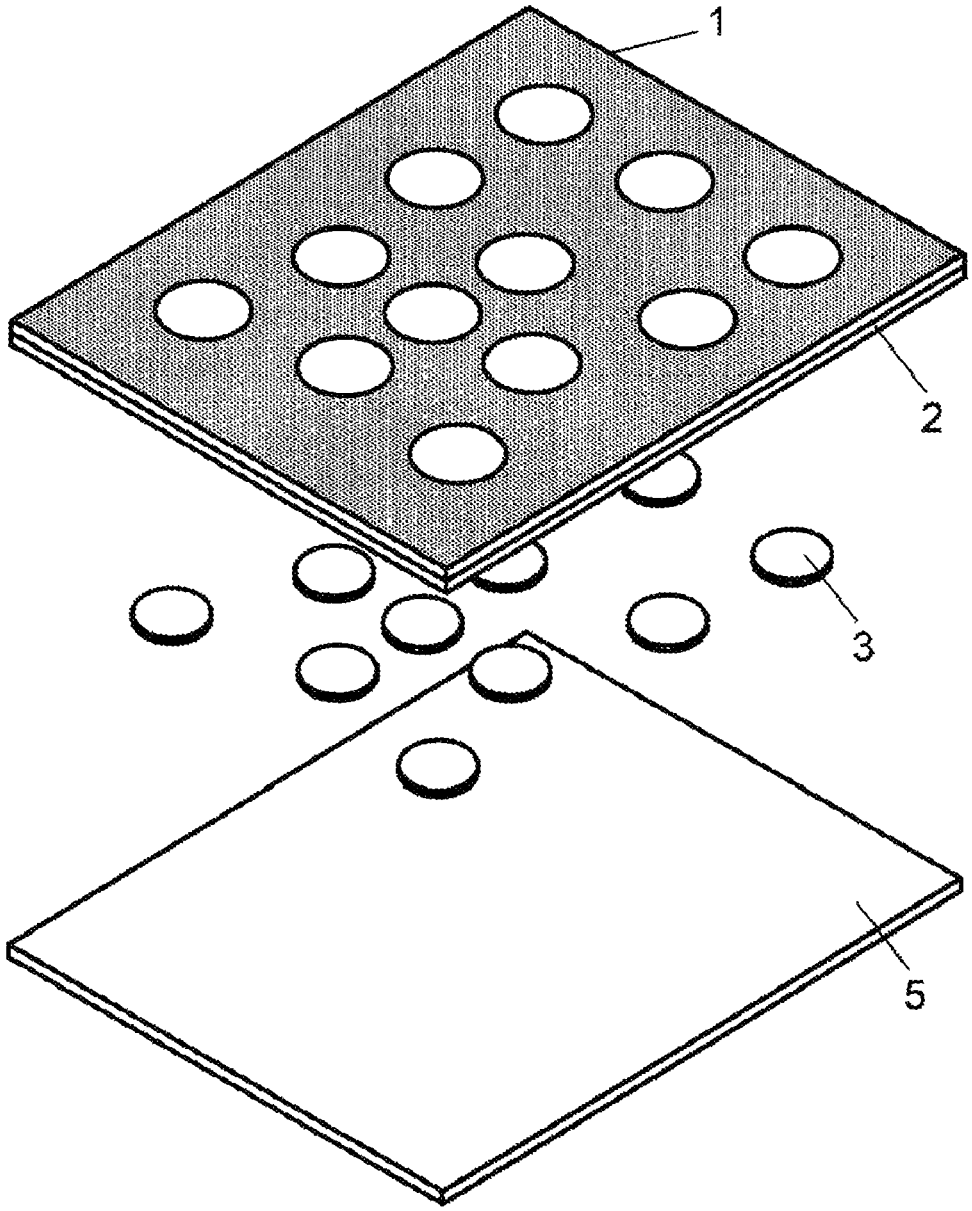
FIG. 7 Prior Art
FIG. 7 is an exploded perspective view of the conventional movable contact unit.
Figure 8:
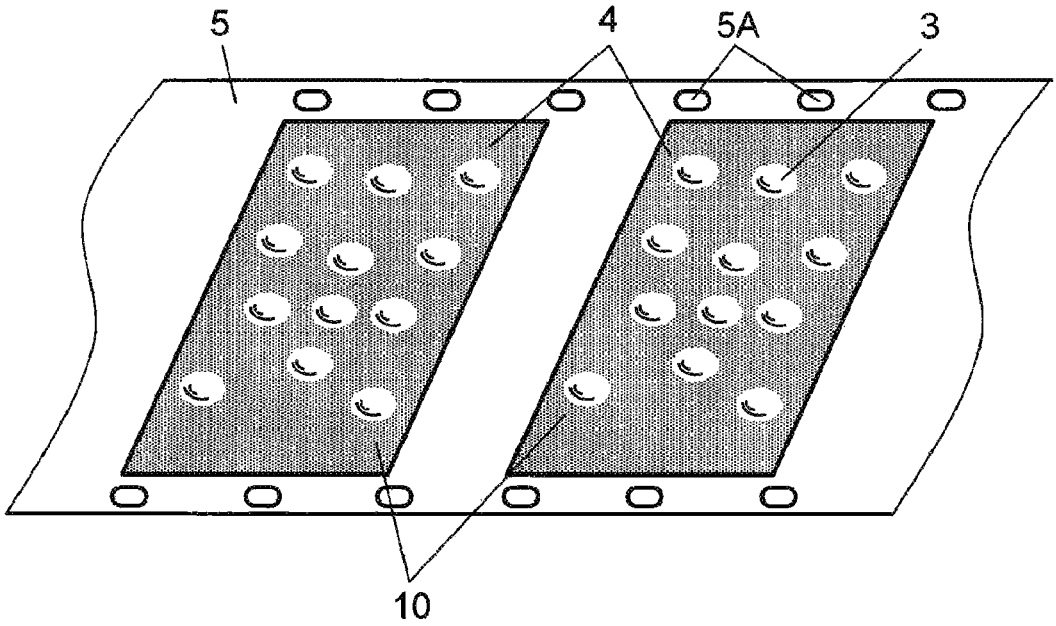
FIG. 8 Prior Art
FIG. 8 is a perspective view of the conventional movable contact unit.
Figure 9:
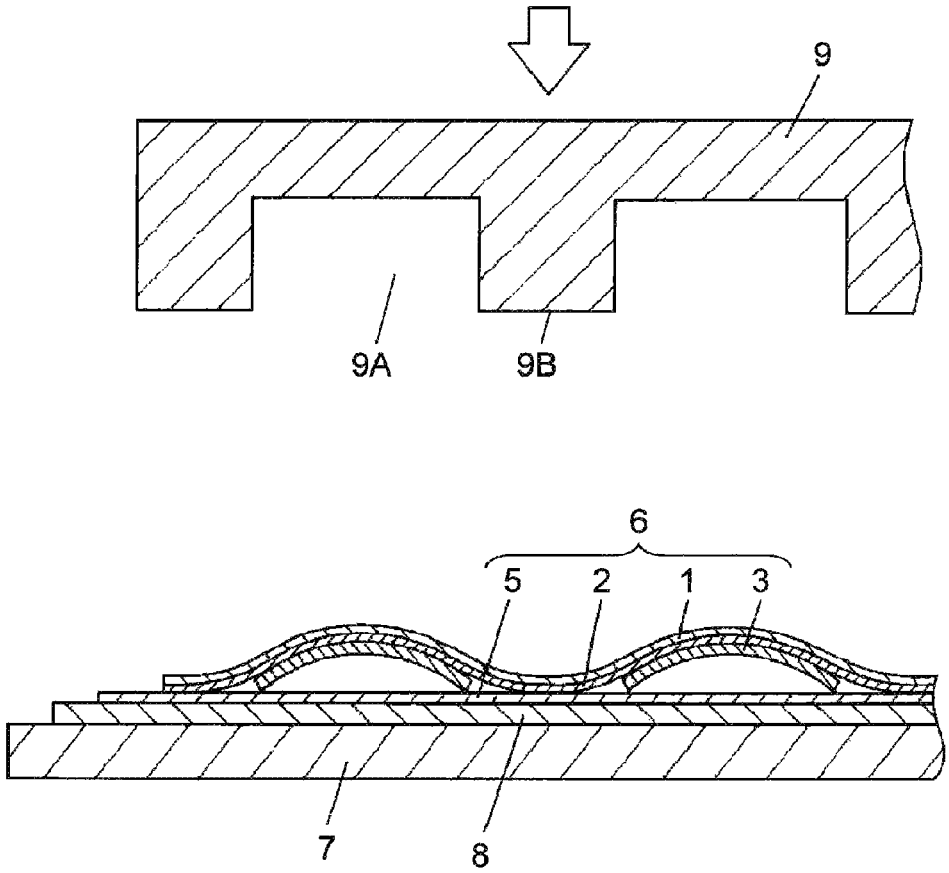
FIG. 9 Prior Art
FIG. 9 is a sectioned view illustrating a method of manufacturing the conventional movable contact unit.
Figure 10:
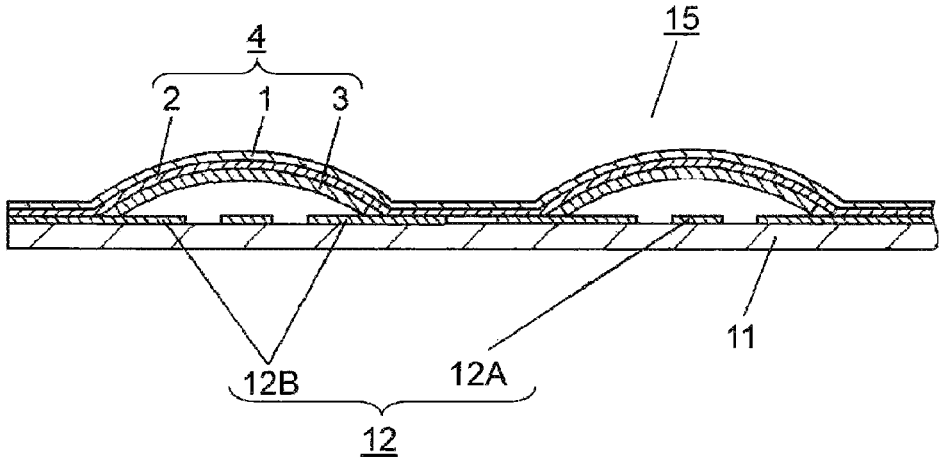
FIG. 10 Prior Art
FIG. 10 is a sectioned view of a switch provided with the conventional movable contact unit.

FIG. 5 is a sectioned view of a switch provided with the movable contact unit according to the present invention. This switch 30 is comprised of movable contact unit 24 removed from aforesaid separator 25 and bonded to an upper surface of wiring board 11. Movable contact unit 24 is bonded to wiring board 11 in a position that outer rims of movable contacts 23, or the constituent elements thereof, lie on outer stationary contacts 12B, and lower center surfaces of movable contacts 23 confront respective center stationary contacts 12A with a predetermined space between them.

Switch 30 of the above structure is assembled within an enclosure case of an electronic apparatus such as a mobile phone in a manner so that movable contacts 23 are located behind dial buttons and the like, and connected to a control circuit. The control circuit detects and executes controlling tasks of the electronic apparatus when the dial buttons are pushed.

In this exemplary embodiment, what has been described is a typical configuration, in which belt-like separator 25 carrying a plurality of movable contact units 24 is used in the process of bonding movable contact units 24 continuously onto wiring boards 11 as illustrated in FIG. 4. However, the present invention is also adaptable to separators 25 of generally the same size as movable contact unit 24, and carrying a single unit of movable contact unit 24 individually. The present invention, when applied, reduces deformation of base film 21 and separator 25 attributed to the heat as compared to the prior art. It is therefore an advantage of this invention to improve an efficiency of manufacturing the movable contact units as well as a productivity of electronic apparatuses when applied to the apparatuses requiring switches of a higher accuracy of the bonding position than before.

In addition, what has been described in this exemplary embodiment is an example, in which adhesive layer 22 on the underside of base film 21 is formed over the entire surface of base film 21. However, base film 21 may have certain areas in press-on portions 28 around the surfaces fixing movable contacts 23 where adhesive layer 22 is not provided in a manner to form passages communicating with the outer rims of adjoining movable contacts 23. This structure achieves movable contact unit 24 having an outstanding click response when being pressed since it allows the air under any of dome-like movable contacts 23 being pressed to escape through the areas not provided with adhesive layer 22 toward adjoining movable contacts 23.

According to this exemplary embodiment, as discussed above, movable contact unit 24 comprises base film 21 made of an insulation film, adhesive layer 22 formed on the underside of base film 21, and downwardly opened dome-like movable contact 23 adhesively fixed to adhesive layer 22, wherein movable contact unit 24 is hot-pressed around the peripheral part of movable contact 23 to make base film 21 in close adhesion with the dome-like shape of movable contact 23, and to form the press-on portion of generally circular shape around the peripheral part of movable contact 23, or the base of the convex-shaped portion of base film 21. The present invention thus enables reduction of the deformation attributed to the process of hot press as compared to the movable contact unit manufactured by the conventional method, thereby providing the novel movable contact unit and the manufacturing method thereof that achieves improvement of the efficiency of manufacturing movable contact units as well as the productivity of electronic apparatuses.

What is claimed is:

1. A movable contact unit comprising:

a base film;

an adhesive layer formed on an underside surface of the base film; and a downwardly opened dome-like movable contact adhesively fixed to the adhesive layer, wherein the base film has a press-on portion of a circular shape formed by heating and pressing only around a peripheral part or a base of a convex-shaped portion retaining the movable contact, the base film is in close adhesion with the movable contact from a dome-like top portion down to an outer rim thereof, and deformation of a portion other than the press-on portion is less than deformation of the press-on portion attributed to the heating and pressing.

2. The movable contact unit of claim 1, wherein the base film has a certain area not provided with the adhesive layer in the press-on portion in a manner to form a passage communicating with an outer rim of an adjoining movable contact.

3. A method of manufacturing a movable contact unit, the method comprising:

a first step of fixing a movable contact of a downwardly opened dome-like shape made of a conductive metal plate having elasticity by adhering an upper center surface thereof to an adhesive layer formed on an underside surface of a base film;

a second step of affixing an upper surface of a separator onto the adhesive layer in a manner to sandwich the movable contact between them; and a third step of heating and pressing in a circular shape the periphery of the movable contact only at a portion around a base of the movable contact from above the base film to form a convex-shaped portion in an area of the base film corresponding to the movable contact in a manner to fit along the dome-like shape of the movable contact, and to make a peripheral area or a base of the convex-shaped portion pressed circularly into close adhesion to the separator with the adhesive layer.

4. A method of claim 3, wherein the heating and pressing are conducted at a temperature ranging from 80° C. to 130° C. with a pressure ranging from 0.1 MPa to 0.3 MPa for a time ranging from 1 to 3 seconds.

5. A method of claim 3, wherein the base film has a certain area not provided with the adhesive layer in the press-on portion in a manner to form a passage communicating with an outer rim of an adjoining movable contact.

6. A movable contact unit comprising:

a base film;

an adhesive layer formed on an underside surface of the base film; and a downwardly opened dome-like movable contact adhesively fixed to the adhesive layer, wherein the base film has a press-on portion of a circular shape around a peripheral part or a base of a convex-shaped portion retaining the movable contact, the base film is in close adhesion with the movable contact from a dome-like top portion down to an outer rim thereof, and deformation attributed to heating and pressing of a portion other than the press-on portion is less than deformation attributed to heating and pressing of the press-on portion.

7. The movable contact unit of claim 6, wherein the base film has a press-on portion of a circular shape around only the peripheral part.

* * * * *